US010186232B2

(12) United States Patent
Huang et al.

(10) Patent No.: US 10,186,232 B2
(45) Date of Patent: Jan. 22, 2019

(54) NONLINEAR SIGNAL SCALING FOR DISPLAY DEVICE POWER SAVING

(71) Applicant: QUALCOMM Incorporated, San Diego, CA (US)

(72) Inventors: Ai-Mei Huang, San Ramon, CA (US); Min Dai, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 15/224,817

(22) Filed: Aug. 1, 2016

(65) Prior Publication Data

US 2018/0033397 A1 Feb. 1, 2018

(51) Int. Cl.

| | |
|---|---|
| ***G09G 5/10*** | (2006.01) |
| ***G09G 3/20*** | (2006.01) |
| ***G09G 5/02*** | (2006.01) |
| ***G09G 3/32*** | (2016.01) |
| ***G09G 3/3208*** | (2016.01) |

(52) U.S. Cl.

CPC ..... *G09G 5/10* (2013.01); *G09G 3/2003* (2013.01); *G09G 3/2011* (2013.01); *G09G 3/3208* (2013.01); *G09G 5/02* (2013.01); *G09G 2320/0271* (2013.01); *G09G 2320/066* (2013.01); *G09G 2330/021* (2013.01); *G09G 2330/023* (2013.01); *G09G 2360/144* (2013.01); *G09G 2360/16* (2013.01)

(58) Field of Classification Search

None

See application file for complete search history.

(56) References Cited

U.S. PATENT DOCUMENTS

| | | | | |
|---|---|---|---|---|
| 8,466,856 | B2 | 6/2013 | Hamer et al. | |
| 2005/0270265 | A1 | 12/2005 | Plut | |
| 2007/0268524 | A1* | 11/2007 | Nose | G09G 3/2007 358/3.01 |
| 2008/0204475 | A1 | 8/2008 | Kim et al. | |
| 2010/0074553 | A1 | 3/2010 | Choi et al. | |
| 2010/0225673 | A1 | 9/2010 | Miller et al. | |
| 2011/0069089 | A1* | 3/2011 | Kopf | G09G 3/3208 345/690 |

(Continued)

FOREIGN PATENT DOCUMENTS

CN 105070252 A 11/2015

OTHER PUBLICATIONS

"HSL and HSV," retrieved on Feb. 5, 2016, from https://en.wikipedia.org/wiki/HSL_and_HSV, 23 pp.

(Continued)

*Primary Examiner* — Nurun N Flora

(74) *Attorney, Agent, or Firm* — Shumaker & Sieffert, P.A.

(57) ABSTRACT

Techniques are described in which pixel intensity values of a display of a computing device may be nonlinearly scaled down to reduce the power consumption of the display. The computing device may determine a compressed pixel brightness range for the display. The computing device may determine a set of initial scaled pixel intensity levels based at least in part on the compressed pixel intensity range. The computing device may determine a set of scaled pixel intensity values based at least in part on an estimated power consumption value associated with the set of initial scaled pixel intensity levels. The computing device may scale the pixel brightness of pixels of the display from one of a plurality of pixel intensity levels to a corresponding scaled pixel intensity level of the set of scaled pixel intensity levels.

26 Claims, 5 Drawing Sheets

(56) References Cited

U.S. PATENT DOCUMENTS

| | | | | |
|---|---|---|---|---|
| 2011/0298843 | A1 | 12/2011 | Hajjar et al. | |
| 2015/0029394 | A1 | 1/2015 | Fernandes et al. | |
| 2016/0358584 | A1* | 12/2016 | Greenebaum | G09G 5/02 |
| 2017/0047035 | A1 | 2/2017 | Li et al. | |

OTHER PUBLICATIONS

Shin et al., "Dynamic Voltage Scaling of OLED Displays," Jun. 5-10, 2011; DAC '11 Proceedings of the 48th Design Automation conference, pp. 53-58.

"10 apps that save your battery with dark, AMOLED-friendly modes," Greenbot, retrieved on Nov. 12, 2015 from http://www.grenbot.com/category/apps/, 4 pp.

"Pixel OFF Save Batter AMOLED," Play Google, retrieved on Nov. 12, 2015 from https://play.google.com/store/apps/details?id=com.anrapps.pixelbatterysaver&hl=en, 7 pp.

Lee et al., "Power-Constrained Contrast Enhancement for Emissive Displays Based on Histogram Equalization," IEEE Trans. Image Process, vol. 21, No. 2, Jan. 2012; pp. 80-93.

Nam et al., "Power-Constrained Contrast Enhancement Algorithm Using Multiscale Retinex for OLED Display," IEEE Trans. Image Process, vol. 23, No. 8, Aug. 2014, pp. 3308-3320.

International Search Report and Written Opinion—PCT/US2017/033848—ISA/EPO—Aug. 18, 2017—20 pp.

Response to Written Opinion filed May 29, 2018 in International Application No. PCT/US2017/033848, 6 pp.

Second Written Opinion issued in International Application No. PCT/US2017/033848 dated Jul. 3, 2018, 14 pp.

* cited by examiner

NONLINEAR SIGNAL SCALING FOR DISPLAY DEVICE POWER SAVING

TECHNICAL FIELD

This disclosure relates to display device power saving.

BACKGROUND

Mobile computing devices are powered by batteries of limited size and/or capacity. The display device of a mobile computing device may be a significant consumer of power in mobile devices. As such, it is beneficial to reduce the power consumption of the display device in order to prolong battery life without significantly reducing the output quality of the display device to the user. If the display device of a computing device includes a liquid crystal display (LCD), the computing device may reduce the power consumption of the display device by turning down its backlight while boosting pixel values of the LCD to maintain the final luminance of the LCD.

SUMMARY

In general, this disclosure describes techniques for display device power saving, and more specifically to techniques for nonlinearly scaling pixel values of a display device to meet a target power consumption goal for the display device while preserving the contrast of the display device. The techniques disclosed herein may also increase the viewing comfort of a user viewing the display device in the dark by preserving the contrast of the display device while reducing the peak luminance of the display device.

In one aspect, the disclosure is directed to a method. The method may include determining, by at least one processor, a compressed pixel intensity range for a plurality of pixel intensity levels of a display device based at least in part on a target power scaling value. The method may further include determining, by the at least one processor, a set of initial scaled pixel intensity levels for the plurality of pixel intensity levels based at least in part on the compressed pixel intensity range. The method may further include determining, by the at least one processor, a set of scaled pixel intensity levels based at least in part on an estimated power consumption value associated with the set of initial scaled pixel intensity levels. The method may further include scaling a pixel intensity of each of a plurality of pixels of the display device from one of the plurality of pixel intensity levels to a corresponding scaled pixel intensity level of the set of scaled pixel intensity levels.

In another aspect, the disclosure is directed to a computing device. The computing device may include a display. The computing device may further include at least one processor configured to: determine a compressed pixel intensity range for a plurality of pixel intensity levels of the display based at least in part on a target power scaling value; determine a set of initial scaled pixel intensity levels for the plurality of pixel intensity levels based at least in part on the compressed pixel intensity range; determine a set of scaled pixel intensity levels based at least in part on an estimated power consumption value associated with the set of initial scaled pixel intensity levels; and scale a pixel intensity of each of a plurality of pixels of the display from one of the plurality of pixel intensity levels to a corresponding scaled pixel intensity level of the set of scaled pixel intensity levels.

In another aspect, the disclosure is directed to a computer-readable storage medium storing instructions that, when executed, cause at least one processor to: determine a compressed pixel intensity range for a plurality of pixel intensity levels of a display device based at least in part on a target power scaling value; determine a set of initial scaled pixel intensity levels for the plurality of pixel intensity levels based at least in part on the compressed pixel intensity range; determine a set of scaled pixel intensity levels based at least in part on an estimated power consumption value associated with the set of initial scaled pixel intensity levels; and scale a pixel intensity of each of a plurality of pixels of the display device from one of the plurality of pixel intensity levels to a corresponding scaled pixel intensity level of the set of scaled pixel intensity levels.

In another aspect, the disclosure is directed to an apparatus. The apparatus may include means for determining a compressed pixel intensity range for a plurality of pixel intensity levels of a display device based at least in part on a target power scaling value. The apparatus may further include means for determining a set of initial scaled pixel intensity levels for the plurality of pixel intensity levels based at least in part on the compressed pixel intensity range. The apparatus may further include means for determining a set of scaled pixel intensity levels based at least in part on an estimated power consumption value associated with the set of initial scaled pixel intensity levels. The apparatus may further include means for scaling a pixel intensity of each of a plurality of pixels of the display device from one of the plurality of pixel intensity levels to a corresponding scaled pixel intensity level of the set of scaled pixel intensity levels.

The details of one or more examples of the disclosure are set forth in the accompanying drawings and the description below. Other features, objects, and advantages of the disclosure will be apparent from the description and drawings, and from the claims.

DETAILED DESCRIPTION

Figure 1:
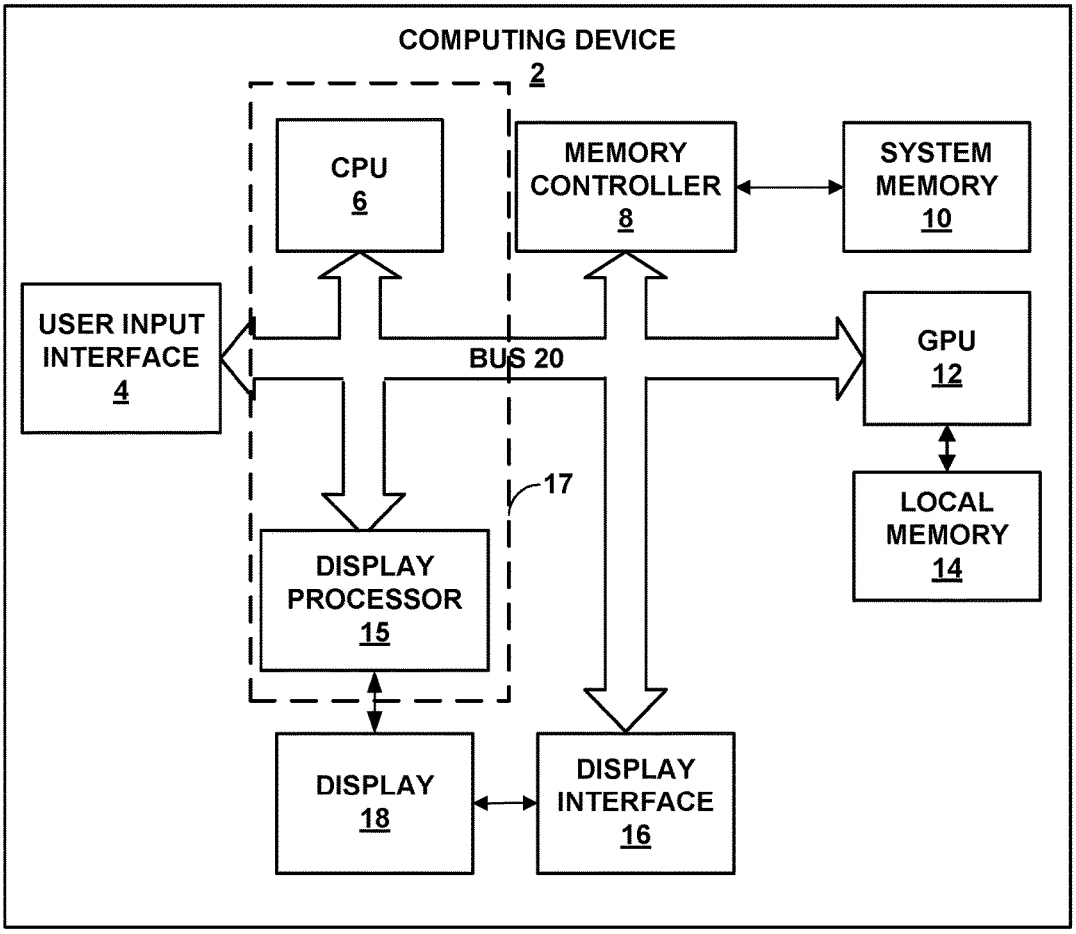
FIG. 1 is a block diagram illustrating an example device in accordance with one or more example techniques described in this disclosure.

In general, this disclosure describes techniques for display device power saving, and more specifically to techniques for nonlinearly scaling pixel values of a display device to meet a target power consumption goal for the display device while preserving the contrast of the display device.

Increasingly, mobile computing devices are utilizing display devices such as organic light-emitting-diode (OLED) displays that do not include a backlight, which may potentially make it more difficult to save power without impacting visual quality of images displayed by the display device. Due to the lack of a backlight, the display device may not be able to reduce its power consumption by simply turning down or turning off its backlight. Thus, in some examples, the display device may primarily reduce its power consumption by reducing the luminance levels (i.e., intensity levels) of its pixels.

The pixels of a display device may each output a particular pixel color in order to form an image that is displayed by the display device. The output pixel colors of the pixels of a display device may be defined according to a color model. Some exemplary color models may include a red, green, and blue (RGB) color model, a YUV color model, or a cyan, magenta, yellow, and key (CMYK) color model. In some examples, the output colors of the pixels of a display device may be defined according to a color model that includes a pixel intensity component. For example, the output pixel colors of the pixels of a display device may be defined according to a hue, saturation, value (HSV) color model, a hue, saturation, brightness (HSB) color model, or a hue, saturation, luminance (HSL) color model. In the example of the HSV, HSB, and HSL color models, the value, brightness, and luminance components of the respective color models may be or otherwise correspond with the pixel intensity component of the respective color models, such that it may correspond with the pixel intensity level of pixels of a display.

Aspects of this disclosure are directed to reducing the power consumption of a display device that is included in or operably coupled to a computing device by reducing the pixel intensity level of pixels of the display device independent of any changes to the hue and saturation of the pixels of the display device. Thus, in some examples, the computing device may reduce the pixel intensity level of pixels of the display device without modifying the hue and saturation of the pixels of the display device.

In some examples, the computing device may determine a compressed pixel intensity range for a plurality of pixel intensity levels of a display device based at least in part on a target power scaling value. The computing device may determine a set of initial scaled pixel intensity levels for the plurality of pixel intensity levels based at least in part on the compressed pixel intensity range. The computing device may determine a set of scaled pixel intensity levels based at least in part on an estimated power consumption value associated with the set of initial scaled pixel intensity levels. The computing device may scale a pixel intensity of each of a plurality of pixels of the display device from one of the plurality of pixel intensity levels to a corresponding scaled pixel intensity level of the set of scaled pixel intensity levels.

FIG. 1 is a block diagram illustrating an example computing device 2 that may be used to implement techniques of this disclosure. Computing device 2 may comprise a personal computer, a desktop computer, a laptop computer, a computer workstation, a video game platform or console, a wireless communication device (such as, e.g., a mobile telephone, a cellular telephone, a satellite telephone, and/or a mobile telephone handset), a landline telephone, an Internet telephone, a handheld device such as a portable video game device or a personal digital assistant (PDA), a personal music player, a video player, a display device, a television, a television set-top box, a server, an intermediate network device, a mainframe computer, a mobile computing device, or any other type of device that processes and/or displays graphical data.

As illustrated in the example of FIG. 1, computing device 2 includes a user input interface 4, a CPU 6, a memory controller 8, a system memory 10, a graphics processing unit (GPU) 12, a local memory 14, a display interface 16, a display 18 and bus 20. User input interface 4, CPU 6, memory controller 8, GPU 12 and display interface 16 may communicate with each other using bus 20. Bus 20 may be any of a variety of bus structures, such as a third generation bus (e.g., a HyperTransport bus or an InfiniBand bus), a second generation bus (e.g., an Advanced Graphics Port bus, a Peripheral Component Interconnect (PCI) Express bus, or an Advanced eXentisible Interface (AXI) bus) or another type of bus or device interconnect. It should be noted that the specific configuration of buses and communication interfaces between the different components shown in FIG. 1 is merely exemplary, and other configurations of computing devices and/or other graphics processing systems with the same or different components may be used to implement the techniques of this disclosure.

CPU 6 may comprise a general-purpose or a special-purpose processor that controls operation of computing device 2. A user may provide input to computing device 2 to cause CPU 6 to execute one or more software applications. The software applications that execute on CPU 6 may include, for example, an operating system, a word processor application, an email application, a spread sheet application, a media player application, a video game application, a graphical user interface application or another program. The user may provide input to computing device 2 via one or more input devices (not shown) such as a keyboard, a mouse, a microphone, a touch pad or another input device that is coupled to computing device 2 via user input interface 4. In some examples, user input interface 4 may comprise one or more ambient light sensors that may sense a brightness or intensity of ambient visible light and may provide indications of the sensed brightness or intensity of the ambient visible light to CPU 6 and GPU 12. For example, if computing device 2 is a mobile computing device, the one or more ambient light sensors may be integrated into the housing of computing device 2.

The software applications that execute on CPU 6 may include one or more graphics rendering instructions that instruct CPU 6 to cause the rendering of graphics data to display 18. In some examples, the software instructions may conform to a graphics application programming interface (API), such as, e.g., an Open Graphics Library (OpenGL®) API, an Open Graphics Library Embedded Systems (OpenGL ES) API, an OpenCL API, a Direct3D API, an X3D API, a RenderMan API, a WebGL API, or any other public or proprietary standard graphics API. The techniques should not be considered limited to requiring a particular API.

In order to process the graphics rendering instructions, CPU 6 may issue one or more graphics rendering commands to GPU 12 to cause GPU 12 to perform some or all of the rendering of the graphics data. In some examples, the graphics data to be rendered may include a list of graphics primitives, e.g., points, lines, triangles, quadralaterals, triangle strips, etc.

Memory controller 8 facilitates the transfer of data going into and out of system memory 10. For example, memory controller 8 may receive memory read and write commands, and service such commands with respect to system memory 10 in order to provide memory services for the components in computing device 2. Memory controller 8 is communicatively coupled to system memory 10. Although memory controller 8 is illustrated in the example computing device 2 of FIG. 1A as being a processing module that is separate from both CPU 6 and system memory 10, in other examples, some or all of the functionality of memory controller 8 may be implemented on one or both of CPU 6 and system memory 10.

System memory 10 may store program modules and/or instructions that are accessible for execution by CPU 6 and/or data for use by the programs executing on CPU 6. For example, system memory 10 may store user applications and graphics data associated with the applications. System memory 10 may additionally store information for use by and/or generated by other components of computing device 2. For example, system memory 10 may act as a device memory for GPU 12 and may store data to be operated on by GPU 12 as well as data resulting from operations performed by GPU 12. For example, system memory 10 may store any combination of texture buffers, depth buffers, stencil buffers, vertex buffers, frame buffers, or the like. In addition, system memory 10 may store command streams for processing by GPU 12. System memory 10 may include one or more volatile or non-volatile memories or storage devices, such as, for example, random access memory (RAM), static RAM (SRAM), dynamic RAM (DRAM), read-only memory (ROM), erasable programmable ROM (EPROM), electrically erasable programmable ROM (EEPROM), flash memory, a magnetic data media or an optical storage media.

In some aspects, system memory 10 may include instructions that cause CPU 6 and/or GPU 12 to perform the functions ascribed in this disclosure to CPU 6 and GPU 12. Accordingly, system memory 10 may be a computer-readable storage medium having instructions stored thereon that, when executed, cause one or more processors (e.g., CPU 6 and GPU 12) to perform various functions.

In some examples, system memory 10 is a non-transitory storage medium. The term "non-transitory" indicates that the storage medium is not embodied in a carrier wave or a propagated signal. However, the term "non-transitory" should not be interpreted to mean that system memory 10 is non-movable or that its contents are static. As one example, system memory 10 may be removed from computing device 2, and moved to another device. As another example, memory, substantially similar to system memory 10, may be inserted into computing device 2. In certain examples, a non-transitory storage medium may store data that can, over time, change (e.g., in RAM).

GPU 12 may be configured to perform graphics operations to render one or more graphics primitives to display 18. Thus, when one of the software applications executing on CPU 6 requires graphics processing, CPU 6 may provide graphics commands and graphics data to GPU 12 for rendering to display 18. The graphics commands may include, e.g., drawing commands such as a draw call, GPU state programming commands, memory transfer commands, general-purpose computing commands, kernel execution commands, etc. In some examples, CPU 6 may provide the commands and graphics data to GPU 12 by writing the commands and graphics data to system memory 10, which may be accessed by GPU 12. In some examples, GPU 12 may be further configured to perform general-purpose computing for applications executing on CPU 6.

GPU 12 may, in some instances, be built with a highly-parallel structure that provides more efficient processing of vector operations than CPU 6. For example, GPU 12 may include a plurality of processing elements that are configured to operate on multiple vertices or pixels in a parallel manner. The highly parallel nature of GPU 12 may, in some instances, allow GPU 12 to draw graphics images (e.g., GUIs and two-dimensional (2D) and/or three-dimensional (3D) graphics scenes) onto display 18 more quickly than drawing the scenes directly to display 18 using CPU 6. In addition, the highly parallel nature of GPU 12 may allow GPU 12 to process certain types of vector and matrix operations for general-purpose computing applications more quickly than CPU 6.

GPU 12 may, in some instances, be integrated into a motherboard of computing device 2. In other instances, GPU 12 may be present on a graphics card that is installed in a port in the motherboard of computing device 2 or may be otherwise incorporated within a peripheral device configured to interoperate with computing device 2. In further instances, GPU 12 may be located on the same microchip as CPU 6 forming a system on a chip (SoC). GPU 12 and CPU 6 may include one or more processors, such as one or more microprocessors, application specific integrated circuits (ASICs), field programmable gate arrays (FPGAs), digital signal processors (DSPs), or other equivalent integrated or discrete logic circuitry.

GPU 12 may be directly coupled to local memory 14. Thus, GPU 12 may read data from and write data to local memory 14 without necessarily using bus 20. In other words, GPU 12 may process data locally using a local storage, instead of off-chip memory. This allows GPU 12 to operate in a more efficient manner by eliminating the need of GPU 12 to read and write data via bus 20, which may experience heavy bus traffic. In some instances, however, GPU 12 may not include a separate cache, but instead utilize system memory 10 via bus 20. Local memory 14 may include one or more volatile or non-volatile memories or storage devices, such as, e.g., random access memory (RAM), static RAM (SRAM), dynamic RAM (DRAM), erasable programmable ROM (EPROM), electrically erasable programmable ROM (EEPROM), flash memory, a magnetic data media or an optical storage media.

As described, CPU 6 may offload graphics processing to GPU 12, such as tasks that require massive parallel operations. As one example, graphics processing requires massive parallel operations, and CPU 6 may offload such graphics processing tasks to GPU 12. However, other operations such as matrix operations may also benefit from the parallel processing capabilities of GPU 12. In these examples, CPU 6 may leverage the parallel processing capabilities of GPU 12 to cause GPU 12 to perform non-graphics related operations.

In the techniques described in this disclosure, a first processing unit (e.g., CPU 6) offloads certain tasks to a second processing unit (e.g., GPU 12). To offload tasks, CPU 6 outputs commands to be executed by GPU 12 and data that are operands of the commands (e.g., data on which the commands operate) to system memory 10 and/or directly to GPU 12. GPU 12 receives the commands and data, directly from CPU 6 and/or from system memory 10, and executes the commands. In some examples, rather than storing commands to be executed by GPU 12, and the data operands for the commands, in system memory 10, CPU 6 may store the commands and data operands in a local memory that is local to the IC that includes GPU 12 and CPU 6 and shared by both CPU 6 and GPU 12 (e.g., local memory 14). In general, the techniques described in this disclosure are applicable to the various ways in which CPU 6 may make available the commands for execution on GPU 12, and the techniques are not limited to the above examples.

CPU 6 and/or GPU 12 may store rendered image data in a frame buffer that is allocated within system memory 10. Display interface 16 may retrieve the data from the frame buffer and configure display 18 to display the image represented by the rendered image data. In some examples, display interface 16 may include a digital-to-analog converter (DAC) that is configured to convert the digital values retrieved from the frame buffer into an analog signal consumable by display 18. In other examples, display interface 16 may pass the digital values directly to display 18 for processing.

Display 18 may include a monitor, a television, a projection device, a liquid crystal display (LCD), a plasma display panel, a light emitting diode (LED) array, a cathode ray tube (CRT) display, electronic paper, a surface-conduction electron-emitted display (SED), a laser television display, a nanocrystal display, an organic light-emitting-diode (OLED) display, or another type of display unit. Display 18 may be integrated within computing device 2. For instance, display 18 may be a screen of a mobile telephone handset or a tablet computer. Alternatively, display 18 may be a stand-alone device coupled to computing device 2 via a wired or wireless communications link. For instance, display 18 may be a computer monitor or flat panel display connected to a personal computer via a cable or wireless link.

In accordance with some aspects of the present disclosure, CPU 6 may reduce the power consumed by display 18. In some examples, computing device 2 may include display processor 15 which may perform any or all of the suitable techniques disclosed herein for reducing the power consumed by display 18. Display processor 15 may be any suitable combination of circuitry, hardware logic, integrated circuit, and/or processing units which may be operable to process, control and/or configure how display 18 displays the image represented by the rendered image data. In some examples, display processor 15 may be included in or integrated with display interface 16. As such, either or both of CPU 6 and display processor 15, as well as any other suitable hardware within computing device 2 (e.g., GPU 12) that may be operable to perform any of the power saving techniques disclosed herein.

Thus, throughout this disclosure, CPU 6 and display processor 15 may together be referred to as power saving unit 17. In describing the various techniques that may be performed by power saving unit 17, it should be understood that such techniques may be performed by one or both of CPU 6 and display processor 15. It should be understood that the techniques disclosed herein are not necessarily limited to being performed by CPU 6 or display processor 15, but may also be performed by any other suitable hardware, device, logic, circuitry, processing units, and the like of computing device 2.

Power saving unit 17 may reduce the power consumption of display 18 independently of the backlight level of the display 18. In other words, if display 18 includes or otherwise integrates a backlight, such as in the example of display 18 being an LCD, power saving unit 17 may reduce the power consumption of display 18 without turning down or otherwise reducing the intensity level of the backlight of display 18. Further, power saving unit 17 may reduce the power consumption of display 18 even if display 18 does not include or otherwise integrate a backlight, such as in the example of display 18 being an OLED display.

Power saving unit 17 may reduce the power consumed by display 18 by scaling down the intensity values of pixels of display 18 from pixel intensity levels within a full pixel intensity range to scaled pixel intensity levels within a compressed pixel intensity range, so that display 18 may reduce its power consumption from a relatively higher level of power consumption to a relatively lower level of power consumption. Display 18 may include a set of pixels, and each of the pixels of display 18 may be set to a particular color value to form an image that is displayed by display 18. The particular color value of a pixel may be referred to throughout this disclosure as a pixel value, a pixel color value, a color value, a pixel color, and the like.

The color values of the pixels may form an image that is displayed by display 18. The color values of the pixels of display 18 may be described or represented using any number of suitable color models, such as RGB, CMYK, HSV, HSL, and HSB. Similarly, power saving unit 17 may control the color values of the pixels output by display 18 by adjusting the values of the components of the color models of the pixels of display 18. In the example of an RGB color model, power saving unit 17 may adjust the values of the red, green, and/or blue components of a pixel to control the color value of the pixel. Similarly, in the example of a HSV color model, display 18 may adjust the hue, luminance, and/or value components of a pixel to control the color value of the pixel.

For example, color values of pixels to be output by display 18 may be stored in a frame buffer in system memory 10. To adjust the color values of a pixel, power saving unit 17 may read the color value of the pixel from the frame buffer and direct display 18 to output an adjusted color value for the pixel. For example, power saving unit 17 may determine the luminance component of the color value of the pixel stored in frame buffer, access a lookup table to determine a replacement luminance value for the luminance component of the color value, and may direct display 18 to output a color value having the replacement luminance value for the pixel.

In accordance with aspects of the present disclosure, in order to reduce the power consumption of display 18 without affecting the hue and the saturation of the pixels of display 18, power saving unit 17 may scale down the intensity levels of the pixels of display 18. The intensity levels of the pixels of display 18 may refer to the brightness or luminance of the pixels. Thus, a pixel intensity may also refer to the pixel brightness or the pixel luminance of the pixels of display 18. Power saving unit 17 may further a scaling value for each of one or more pixel intensity levels of pixels of an image displayed by display 18 based at least in part on the compressed pixel intensity range. Power saving unit 17 may further scale a pixel intensity of each of the pixels of the image displayed by display 18 from one of the one or more pixel intensity levels to a scaled pixel intensity level according to the scaling value for the respective one of the one or more pixel intensity levels.

In some examples, the value V of the HSV color model, the brightness B of the HSB color model, and the luminance L of the HSL color model may correspond to the intensity levels of the pixels of display 18. Thus, if the pixel color values of the pixels of display 18 are represented by the HSV color model, power saving unit 17 may operate on the value component (out of the hue, saturation, and value components) of the HSV color model for each of the pixels of display 18 to downscale the intensity levels of the pixels, thereby reducing the power consumption of display 18.

Each pixel of display 18 may have a pixel intensity at a particular pixel intensity level, where a higher pixel intensity level may denote a relatively higher pixel intensity than a relatively lower pixel intensity level. The pixel intensity level of each of the pixels of display 18 may fall within a pixel intensity range of display 18. In one example, the possible pixel intensity of the pixels of display 18 may range from a pixel intensity level of 0 to a pixel intensity level of 255. In other examples, the possible pixel intensity of the pixels of display 18 may range from 0 to 1, 0 to 1024, or any other suitable range of pixel intensity levels.

To scale down the intensity levels of the pixels of display 18, CPU 6 may determine a compressed pixel intensity range for the display 18 based at least in part on a target power scaling value. In other words, CPU 6 may take a full pixel intensity range that display 18 is capable of outputting prior to any compression, such as a pixel intensity range from 0 to a maximum pixel intensity level of 255, and scale the full pixel intensity range of display 18 down to a compressed pixel intensity range, such that pixel intensity levels within the compressed pixel intensity range may range from 0 to a maximum pixel intensity of less than the maximum pixel intensity level within the full pixel intensity range of display 18 (e.g., a maximum pixel intensity of less than 255).

In some examples, a pixel of display 18 may be represented by a set of subpixels or sub-channels. In the example of an OLED display, a pixel of the OLED display may be made up of red, green, blue, and white subpixels. Thus, when a pixel outputs color a particular pixel intensity level, each of the respective subpixels of that pixel may also output color at the same particular pixel intensity level.

In some examples, power saving unit 17 may perform the techniques disclosed herein to scale down the intensity values of pixels of display 18 from pixel intensity levels within a full pixel intensity range to scaled pixel intensity levels within a compressed pixel intensity range based on the brightness or intensity of ambient visible light sensed by the one or more ambient light sensors. In general, if the brightness or intensity of ambient visible light is low (e.g., lower than a specified brightness threshold level), such as when computing device 2 is situated in a low-light environment (e.g., a dark room), power saving unit 17 may perform the techniques disclosed herein to reduce the peak luminance of pixels of display 18 while preserving the contrast of the pixels of display 18. Further, if the brightness or intensity of ambient visible light is high (e.g., higher than a specified brightness threshold level), such as when computing device 2 is situated in a bright environment (e.g., outdoors on a sunny day), power saving unit 17 may perform the techniques disclosed herein to preserve the peak luminance of pixels of display 18 while increasing the contrast of the pixels of display 18.

Figure 2A:
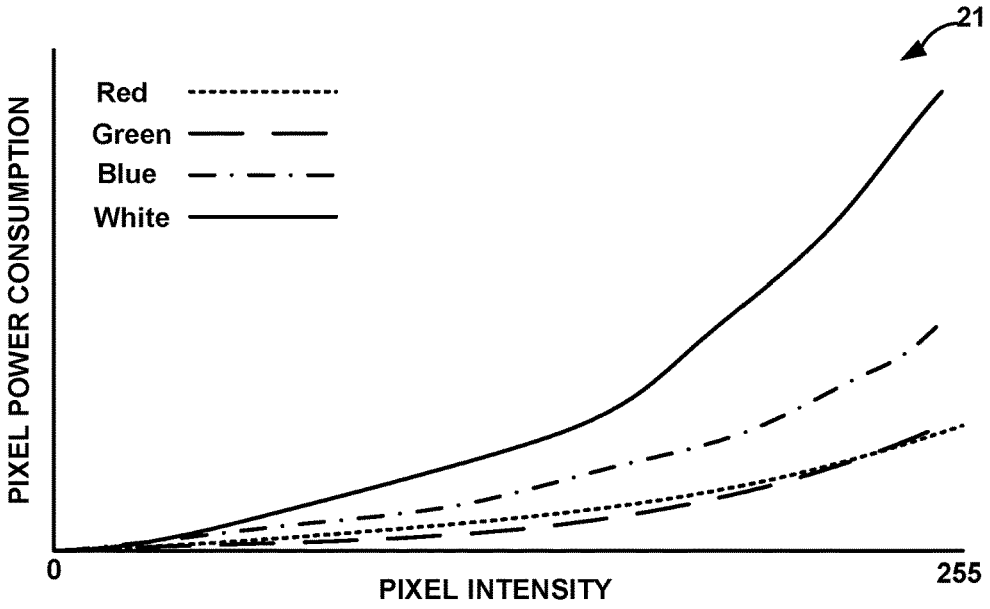
FIGS. 2A-2B are graphs illustrating example pixel intensity versus power consumption of a display.

FIG. 2A is a graph 21 illustrating example pixel intensity versus power consumption of subpixels of display 18 over a full pixel intensity range of display 18. As shown in FIG. 2A, the higher the pixel intensity level of a pixel of display 18, the higher the power consumption of that pixel of display 18, and the power consumption of a pixel of display 18 may increase exponentially with higher pixel intensity levels. As discussed above, in some examples, the color values of the pixels of display 18 may be described via a HSV color model, and the pixel intensity level of pixels of display 18 may, in some examples, correspond to the value component of the HSV color model, such that a higher pixel intensity level may correspond to a higher value component. Further, the pixel intensity level of pixels of display 18 may be independent from the hue and saturation components of the HSV color model.

In the example of FIG. 2A, the full pixel intensity range of display 18 in graph 22 may include a plurality of pixel intensity levels that range from 0 to 255, where a pixel intensity level of 0 may correspond to the minimum pixel intensity level and a pixel intensity level of 255 may correspond to the maximum pixel intensity level. Further, in the example of FIG. 2A, the pixel intensity level may increment by one from 0 to 255, such that the range of pixel intensity levels may include 256 pixel intensity levels. It should be understood that the example pixel intensity range of 0 to 255 is but one example of pixel intensity ranges. It should be understood that the techniques disclosed herein are equally applicable to any other suitable pixel intensity ranges, such as a pixel intensity range of 0 to 1023, a pixel intensity range of 0 to 1, and the like.

In some examples, a pixel of display 18 may be represented by a set of subpixels or sub-channels. In the example of an OLED display, a pixel of the OLED display may be made up of red, green, blue, and white subpixels. Thus, when a pixel outputs color a particular pixel intensity level, each of the respective subpixels of that pixel may also output color at the same particular pixel intensity level.

As shown in FIG. 2A, each of the subpixels (e.g., each of the red, green, blue, and white subpixels) may consume slightly different levels of power even when set to the same intensity level. In accordance with aspects of the present disclosure, to determine the power consumption of the pixels of display 18 that outputs color at a particular pixel intensity level, a single power consumption value is taken from the respective power consumption values of the subpixels at the particular pixel intensity level. Specifically, the power consumption of a pixel at a particular intensity level maybe the maximum power consumed by one of the subpixels out of the power consumed by each of the subpixels at the particular intensity level.

Figure 2B:
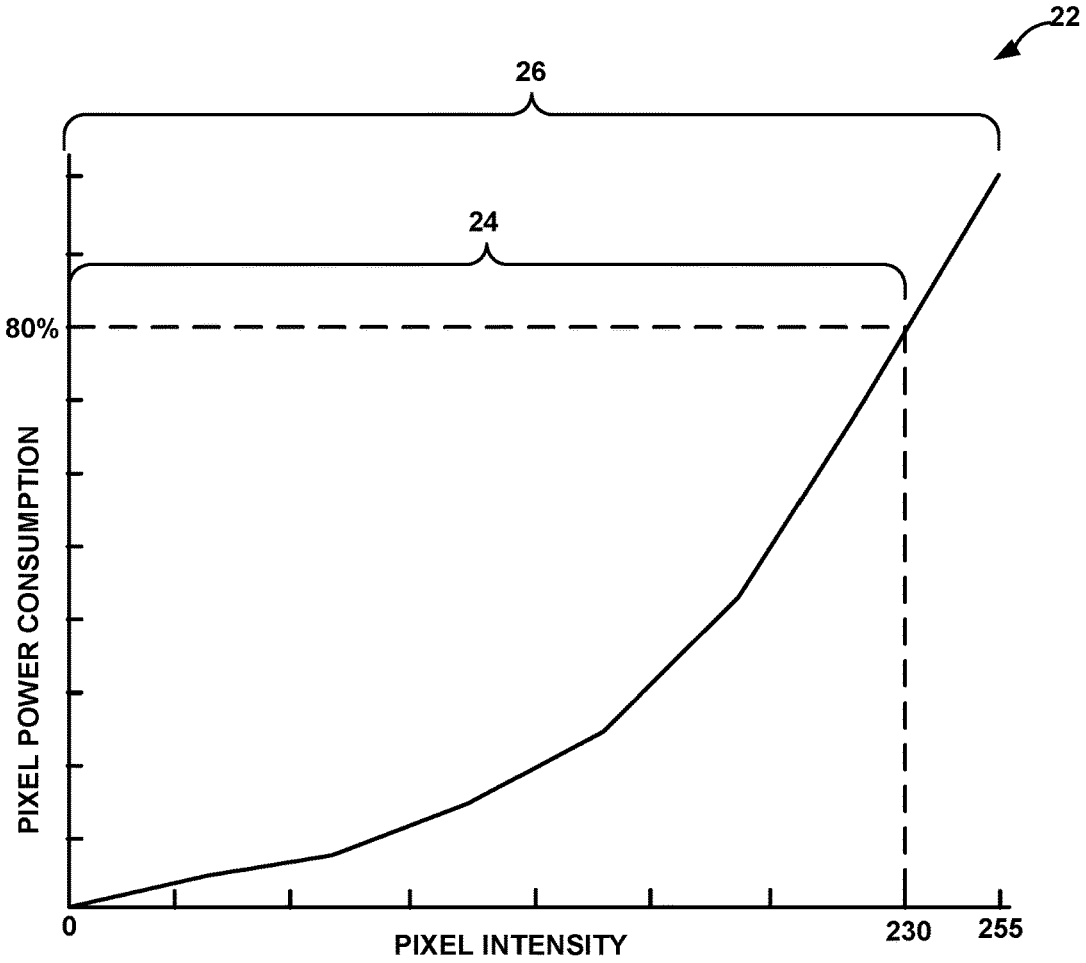

FIG. 2B is a graph 22 illustrating example pixel intensity versus power consumption of pixels of display 18 over a full pixel intensity range of the display 18. As shown in FIG. 2B, the power consumed at a particular pixel intensity level may be the maximum power consumed by one of the subpixels out of the power consumed by each of the subpixels at the particular intensity level.

As shown in FIG. 2B, the higher the pixel intensity level of a pixel of display 18, the higher the power consumption of that pixel of display 18, and the power consumption of a pixel of display 18 may increase exponentially with higher pixel intensity levels. As discussed above, in some examples, the color values of the pixels of display 18 may be described via a HSV color model, and the pixel intensity level of pixels of display 18 may, in some examples, correspond to the value component of the HSV color model, such that a higher pixel intensity level may correspond to a higher value component. Further, the pixel intensity level of pixels of display 18 may be independent from the hue and saturation components of the HSV color model.

Further, like graph 21 shown in FIG. 2A, the full pixel intensity range of display 18 in graph 22 may include a plurality of pixel intensity levels that range from 0 to 255, where a pixel intensity level of 0 may correspond to the minimum pixel intensity level and a pixel intensity level of 255 may correspond to the maximum pixel intensity level. In addition, the pixel intensity level may increment by one from 0 to 255, such that the range of pixel intensity levels may include 256 pixel intensity levels. It should be understood that the example pixel intensity range of 0 to 255 is but one example of pixel intensity ranges. It should be understood that the techniques disclosed herein are equally applicable to any other suitable pixel intensity ranges, such as a pixel intensity range of 0 to 1023, a pixel intensity range of 0 to 1, and the like.

In some examples, a pixel of display 18 may be represented by a set of subpixels or sub-channels. In the example of an OLED display, a pixel of the OLED display may be made up of red, green, blue, and white subpixels. Thus, when a pixel outputs color a particular pixel intensity level, each of the respective subpixels of that pixel may also output color at the same particular pixel intensity level. However, each of the subpixels may consume slightly different levels of power even when set to the same intensity level. In accordance with aspects of the present disclosure, to determine the power consumption of the pixels of display 18 that outputs color at a particular pixel intensity level, a single power consumption value is taken from the respective power consumption values of the subpixels at the particular pixel intensity level. Specifically, the power consumption of a pixel at a particular intensity level maybe the maximum power consumed by one of the subpixels out of the power consumed by each of the subpixels at the particular intensity level. Thus, for example, the power consumption for a pixel at a pixel intensity level of 255 may be the maximum power consumption value out of the power consumed by the red subpixel at a pixel intensity level of 255, the power consumed by the green subpixel at a pixel intensity level of 255, the power consumed by the blue subpixel at a pixel intensity level of 255, and the power consumed by the white subpixel at a pixel intensity level of 255.

The power consumed by a pixel at a particular pixel intensity level may be determined according to the following power model:

$$P(v) = \left(\frac{v}{255}\right)^{\gamma} * 1023,\ \gamma \cong 2.2 \tag{1}$$

In the power model above, v may be the pixel intensity level of the pixel which, in this example, may range from 0 to 255, which may be one example of a full pixel intensity range for display 18. The denominator 255 may correspond to the maximum intensity level of pixels of display 18. Thus, in some examples, the power model may be generalized by replacing the denominator 255 with another maximum intensity level for a particular range of pixel intensity. γ may correspond to the gamma of display 18, which may typically have a gamma of about 2.2, which may vary depending on panel characteristics of display 18. The value 1023 in the power model may be a present max value to convert the power model into a range of integers. In some examples, another value in a power of 2 (minus 1) may be utilized in place of 1023, such as 2047, 4095, and the like. The resulting power consumption value for a pixel at the particular pixel intensity level may be the power consumed, in milliwatt, by a pixel at pixel intensity level v.

In accordance with aspects of the present disclosure, power saving unit 17 may reduce the power consumption of display 18 by determining a compressed pixel intensity range 24 for a plurality of pixel intensity levels of display 18 based at least in part on a target power scaling value. The plurality of pixel intensity levels of display 18 as shown in graph 22 may correspond to a full pixel intensity range 26 for display 18. Thus, when display 18 operates according to the full pixel intensity range 26, each pixel of display 18 may output a color having a pixel intensity at a pixel intensity level that ranges from 0 to 255.

Power saving unit 17 may determine the compressed pixel intensity range 24 of pixel intensity levels for the pixels of display 18 by compressing the full pixel intensity range 26 for display 18 to the compressed pixel intensity range 24. Thus, by compressing the full pixel intensity range 26 to result in the compressed pixel intensity range 24, the compressed pixel intensity range 24 may have a smaller range of pixel intensity levels than the full pixel intensity range 26 for display 18. As such, instead of having pixel intensity levels that range from 0 to 255, as is the case for the full pixel intensity range 26 for display 18, the compressed pixel intensity range 24 may have pixel intensity levels that range from a minimum pixel intensity level of 0 to a maximum pixel intensity level of less than 255. For example, as shown in FIG. 2, pixel intensity levels of compressed pixel intensity range 24 may range from 0 to 230, which is a more limited range of pixel intensity levels than the full pixel intensity range 26 of pixel intensity levels from 0 to 255.

As part of determining compressed pixel intensity range 24, power saving unit 17 may map each pixel intensity level within the full pixel intensity range 26 to a corresponding pixel intensity level within compressed pixel intensity range 24. The pixel intensity levels within compressed pixel intensity range 24 may be referred to as scaled pixel intensity levels to differentiate the pixel intensity levels within compressed pixel intensity range 24 from the pixel intensity levels within the full pixel intensity range 26 for display 18.

Because compressed pixel intensity range 24 has a more limited range of pixel intensity levels than the full pixel intensity range 26 for display 18, it is possible that two or more different pixel intensity levels within the full pixel intensity range 26 for display 18 may map to the same scaled pixel intensity level within compressed pixel intensity range 24. Further, different pixel intensity levels that are relatively far apart within the full pixel intensity range 26 may be mapped to corresponding scaled pixel intensity levels that are relatively closer to each other within the compressed pixel intensity range 24. As such, display 18 operating at the compressed pixel intensity range 24 may have a relatively lower dynamic range than display 18 operating at the full pixel intensity range 26. To change from operating at full pixel intensity range 26 to operating at the compressed pixel intensity range 24, display 18 may change the pixel intensity of the pixels of display 18 from its current pixel intensity levels within the full pixel intensity range 26 to corresponding scaled pixel intensity levels within the compressed pixel intensity range 24.

Power saving unit 17 may compress the full pixel intensity range 26 for display 18 based at least in part on a power consumption target for display 18 to result in compressed pixel intensity range 24. Such a power consumption target may be expressed as the amount of power (e.g., watts or millliwatts of power) that display 18 consumes, the average per-pixel power consumption of display 18, a percentage of the power consumption of display 18 operating at full pixel intensity range 26, and the like.

In one example, power saving unit 17 may compress the full pixel intensity range 26 into compressed pixel intensity range 24 based at least in part on a target power scaling value, which may correspond with a percentage of the power consumption of display 18 operating at a full range of pixel intensity levels. As shown in FIG. 2, power saving unit 17 may determine a target power scaling value of 80% for display 18, which may correspond to display 18 operating to reduce its consumption of power by 20% from its normal (non-power scaled) operations. Expressed in another way, a target power scaling value of 80% for display 18 may correspond to display 18 operating at 80% of the power consumption of display 18 operating at full pixel intensity range 26. power saving unit 17 may represent example target power scaling value of 80% as a target power scaling ratio of 0.8, and may determine compressed pixel intensity range 24 as follows:

$$\text{Range}=P^{-1}(P(255)*\text{TargetPowerScalingRatio }\%) \tag{2}$$

By applying equation (2) to a particular target power scaling ratio PowerScalingRatio %, power saving unit 17 may determine the power consumed at the maximum level of pixel intensity (e.g., a pixel intensity level of 255 for a pixel intensity range of 0 to 255) within the full pixel intensity range 26 for display 18 based on the power model of equation (1), apply the target power scaling ratio (e.g., 0.8) to the power consumed at the maximum level of pixel intensity, and applies an inverse power model of the power model of equation (1) to determine compressed pixel intensity range 24 given a target scaling ratio of 0.8. Specifically, the resulting Range may correspond to the maximum pixel intensity level for compressed pixel intensity range 24, and thereby indicate the compressed pixel intensity range 24 as ranging from 0 to Range. In the example of FIG. 2, Range may correspond to a pixel intensity level of 230. As such, the scaled pixel intensity levels within compressed pixel intensity range 24 may range from a minimum of 0 to a minimum of 230.

Given the resulting Range from equation (2), power saving unit 17 may determine that the possible scaled pixel intensity levels to which the pixel intensity levels within the full pixel intensity range 26 for display 18 may be mapped to, which may range from a minimum scaled pixel intensity level of 0 to a maximum scaled pixel intensity level of 230. As discussed above, each pixel intensity level within the full pixel intensity range 26 for display 18 may be mapped to one of the scaled pixel intensity levels within compressed pixel intensity range 24. To that end, power saving unit 17 may determine a gradient index for compressed pixel intensity range 24 by dividing the maximum scaled pixel intensity level for compressed pixel intensity range 24 by the full pixel intensity range 26 as follows:

$$\text{GradientIndex}=\text{Range}/255 \tag{3}$$

In essence, the gradient index GradientIndex may be the ratio of the maximum scaled pixel intensity level for compressed pixel intensity range 24 to the maximum pixel intensity level for the full pixel intensity range 26. While the maximum pixel intensity level for the full pixel intensity range 26 is 255 in equation (3), it should be understood that the maximum pixel intensity level for the full pixel intensity range 26 may not so limited, and may be any other suitable value depending on how pixel intensity levels are quantified in other suitable techniques.

Figure 3:
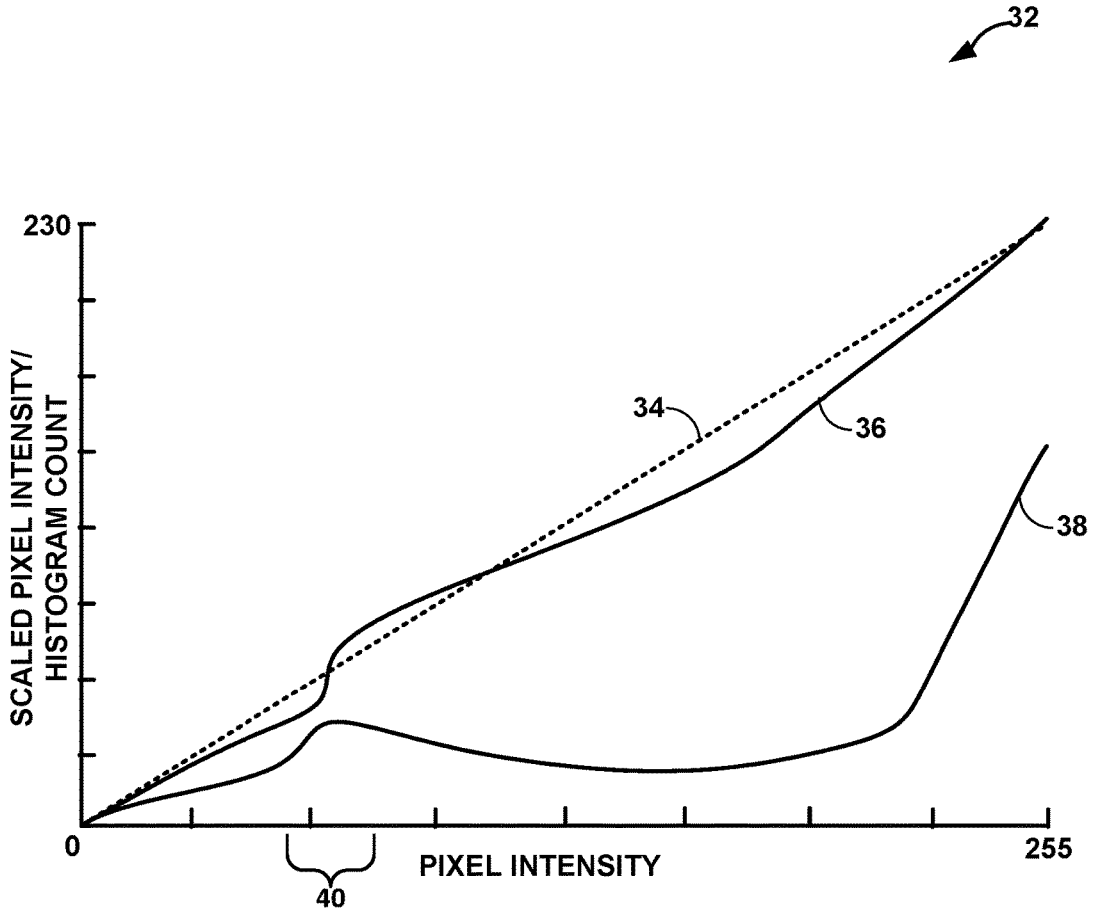
FIG. 3 is a graph illustrating possible scaled pixel intensity levels to which example pixel intensity levels within an example full pixel intensity range may be mapped.

FIG. 3 is a graph illustrating possible scaled pixel intensity levels to which the pixel intensity levels within the full pixel intensity range 26 for display 18 may be mapped. As shown in FIG. 3, the pixel intensity in the x-axis of graph 32 may correspond to pixel intensity levels within the full pixel intensity range 26 and thus, may range from 0 to 255 in the examples where pixel intensity levels within the full pixel intensity range 26 range from 0 to 255. The pixel intensity in the y-axis of graph 32 may correspond to scaled pixel intensity levels within the compressed pixel intensity range 24, and thus, may range from 0 to 230 in the examples where pixel intensity levels within the compressed pixel intensity range 24 range from 0 to 230.

In FIG. 3, naive scaled pixel intensity levels 34 can be generated by multiplying each pixel intensity level by the gradient index resulting from equation (3). As such, naïve scaled pixel intensity level 34 may have a constant slope.

Images displayed by display 18 utilizing the compressed pixel intensity range 24 may have a lower dynamic range than displayed by display 18 utilizing the full pixel intensity range 26 because fewer intensity levels are available for the pixels of display 18. To compensate for the lower dynamic range of compressed pixel intensity range 24, power saving unit 17 may perform contrast enhancement of the pixels of display 18 to nonlinearly scale pixel intensity levels within full pixel intensity range 26 to result in the scaled pixel intensity levels within compressed pixel intensity range 24. Thus, instead of linearly scaling pixel intensity levels within full pixel intensity range 26 to result in naïve scaled pixel intensity level 34, power saving unit 17 may non-linearly scale pixel intensity levels within full pixel intensity range 26 to result in non-linearly scaled pixel intensity level 36.

To perform contrast enhancement, power saving unit 17 may increase the contrast of scaled pixel intensity levels within the compressed pixel intensity range 24 that corresponds to certain pixel intensity levels within the full pixel intensity range 26. Specifically, power saving unit 17 may increase the contrast of a scaled pixel intensity level within the compressed pixel intensity range 24 that corresponds to a pixel intensity level within the full pixel intensity range 26 by increasing the difference (or delta) between that scaled pixel intensity level and a scaled pixel intensity level that corresponds to the immediately lower pixel intensity level within the full pixel intensity range 26. Thus, if $x_k$ is a scaled pixel intensity level that corresponds to pixel intensity level k, and if $x_{k-1}$ is a scaled pixel intensity level that corresponds to pixel intensity level k−1, power saving unit 17 may increase the contrast of $x_k$ by increasing the delta between between $x_k$ and $x_{k-1}$.

More specifically, power saving unit 17 may increase the contrast of scaled pixel intensity levels within the compressed pixel intensity range 24 that corresponds to certain pixel intensity levels within the full pixel intensity range 26 based at least in part on the frequency of occurrence of those certain pixel intensity levels within the pixels of display 18. To that end, power saving unit 17 may construct a histogram of pixel intensity level distribution that indicates the distribution of pixel intensity levels within color values outputted by pixels of display 18. Each of the bins of the histogram may be a pixel intensity level from 0 to 255, and the count (e.g., number of items in the particular bin) of the bin may be the number of pixel of display 18 that output color at the particular pixel intensity level. Thus, the count of a bin in the histogram maybe the frequency of occurrence of the pixel intensity level associated with the bin within the colors output by the pixels of display 18

In FIG. 3, histogram 38 may be an exemplary histogram of pixel intensity level distribution within pixels of display 18 that is overlaid over graph 32. The x-axis of histogram 38 may correspond to bins 0 to 255 that is associated with pixel intensity levels within the full pixel intensity range 26, while the y-axis of histogram 38 may correspond to the frequency for each of the associated pixel intensity levels To generate histogram 38, power saving unit 17 may, for each pixel intensity level within the full pixel intensity range 26, determine the number of pixels of display 18 that output a color value at that particular pixel intensity level, and may set the count of the bin corresponding to that particular pixel intensity level to the determined number of pixels. For example, if 400 pixels of display 18 output a color value at a pixel intensity level of 32, and if 56 pixels of display 18 output a color value at a pixel intensity level of 240, then power saving unit 17 may set the count of the bin corresponding to pixel intensity level of 32 to 400, and may set the count of the bin corresponding to pixel intensity level 240 to 56. In this way, power saving unit 17 may construct histogram 38 of pixel intensity levels for the pixels of display 18 operating according to the full pixel intensity range 26.

Power saving unit 17 may generate non-linearly scaled pixel intensity levels 36 based at least in part on histogram 38. As shown in FIG. 3, power saving unit 17 may adaptively change the slope of non-linearly scaled pixel intensity levels 36 based on the count of corresponding bins of histogram 38. For example, because the count of the bins of histogram 38 within pixel intensity level region 40 shows a spike within histogram 38, the portion of non-linearly scaled pixel intensity levels 36 within pixel intensity level region 40 may have a bigger slope than compared with neighboring portions of non-linearly scaled pixel intensity level 36.

To determine non-linearly scaled pixel intensity levels 36 based at least in part on histogram 38, power saving unit 17 may determine a contrast enhancement index $C_k$ for each pixel intensity level in the full range of (i.e., uncompressed) pixel intensity levels (e.g., from 0 to 255) of display 18 based at least in part on the histogram (e.g., histogram 38) of pixel intensity levels for the pixels of display 18 operating according to the full pixel intensity range 26, where k is a pixel intensity level from 0 to 255, and k=0, 1, . . . , 255, and where $h_k$ is the count or frequency of the number of pixels of display 18 that output a color value at that particular pixel intensity level k while display 18 operates according to the full pixel intensity range 26, as follows:

$$c_k = \mathrm{Clip}\left(\frac{h_k}{\sum_1^{255} h_k}, GradientIndex^{-1}, GradientIndex\right) \tag{4}$$

In equation (4), $c_k$ may be a contrast enhancement index for pixel intensity level k. The contrast enhancement index $c_k$ for a particular pixel intensity level k may correspond to a ratio of the frequency $h_k$ of the pixel intensity level k over the sum $\Sigma_1^{255} h_k$. Thus, it generally follows that the greater the frequency $h_k$ of the pixel intensity level k, the greater the corresponding contrast enhancement index $c_k$ for pixel intensity level k.

As shown in equation (4), power saving unit 17 may limit the minimum and maximum values for contrast enhancement index $c_k$ according to the value of GradientIndex determined previously using equation (3). Specifically, power saving unit 17 may clip the minimum and maximum values of contrast enhancement index $c_k$ so that the minimum value of contrast enhancement index $c_k$ is the gradient index GradientIndex, and the maximum value of contrast enhancement index $c_k$ is one over the gradient index, or $$\frac{1}{GradientIndex}.$$

Thus, it the gradient index is 0.8, then the minimum value of contrast enhancement index $c_k$ is 0.8, and the maximum value of contrast enhancement index $c_k$ is 1.25. In other examples, the clipping range may be predefined to any other suitable parameters.

Power saving unit 17 may determine a set of initial scaled pixel intensity levels within the compressed pixel intensity range 24 for the plurality of pixel intensity levels within the full pixel intensity range 26. Specifically, power saving unit 17 may determine a set of initial scaled pixel intensity levels $x_k$ within compressed pixel intensity range 24 for each of one or more pixel intensity levels k within the full pixel intensity range 26 based at least in part on the compressed pixel intensity range 24 that is determined according to equation (2) and the contrast enhancement index $c_k$ that is determined according to equation (4) as follows:

$$x_k = x_{k-1} + \left(\frac{c_k}{\sum_1^{255} c_k} * \mathrm{Range}\right), x_0 = 0, x_k = 0, 1, \ldots, 255 \tag{5}$$

The set of initial scaled pixel intensity levels that power saving unit 17 determines may correspond to non-linearly scaled pixel intensity levels 36 shown in FIG. 3. Given pixel intensity levels k within the full pixel intensity range 26, power saving unit 17 may determine an initial scaled pixel intensity levels $x_k$ for each pixel intensity level k.

The contrast of the initial scaled pixel intensity value $x_k$ that corresponds to intensity level k may be the difference in intensity between $x_k$ and $x_{k-1}$, where $x_{k-1}$ corresponds to intensity level k−1. As can be seen in equation (5), power saving unit 17 determines the initial scaled pixel intensity level $x_k$ for pixel intensity level k as a delta that is added to the initial scaled pixel intensity level $x_{k-1}$ for pixel intensity level k−1. Thus, contrast enhancement $c_k$ for pixel intensity level k may correlate with the contrast of initial scaled pixel intensity level $x_k$. Specifically, the greater the contrast enhancement index $c_k$ for pixel intensity level k, the greater the delta between initial scaled pixel intensity level $x_k$ for pixel intensity level k and the initial scaled pixel intensity level $x_{k-1}$ for the next lowest pixel intensity level k−1. As such, the greater the contrast enhancement index $c_k$ for pixel intensity level k, the greater the increase in the corresponding initial scaled pixel intensity level within compressed pixel intensity range 24 for pixel intensity level k compared with the corresponding initial scaled pixel intensity level within compressed pixel intensity range 24 for pixel intensity level k−1.

In essence, by determining histogram 38 to determine contrast enhancement indices $c_k$, and by determining the set of initial scaled pixel intensity levels $x_k$ that are non-linearly scaled with respect to pixel intensity levels k, power saving unit 17 performs histogram equalization with respect to the set of initial scaled pixel intensity levels $x_k$. As such, if power saving unit 17 sets the pixel intensity level k of each of the pixels of display 18 with corresponding initial scaled pixel intensity level $x_k$, the set of initial scaled pixel intensity levels $x_k$ may be more equally distributed in the colors output by the pixels of display 18 compared with pixel intensity levels k.

Each pixel intensity level k corresponds to a particular initial scaled pixel intensity level $x_k$, as determined via equation (5). Power saving unit 17 may store such association of k to $x_k$ into system memory 10, such as creating a lookup table in system memory 10, and storing into the lookup table the association of each pixel intensity level k within full pixel intensity range 26 to a particular initial scaled pixel intensity level $x_k$ within compressed pixel intensity range 24. Power saving unit 17 may index into the lookup table using pixel intensity level k to determine the corresponding initial scaled pixel intensity level $x_k$.

To scale down the power consumption of display 18, power saving unit 17 may scale the pixel intensity of each of the pixels of display 18 from one of the plurality of pixel intensity levels to a corresponding scaled pixel intensity level of the set of scaled pixel intensity levels. Specifically, for each pixel of display 18, power saving unit 17 may determine the pixel intensity level k at which the pixel outputs a color, and may look up, such as via a lookup table, the corresponding initial scaled pixel intensity level $x_k$. Power saving unit 17 may then change the pixel intensity of the pixel from pixel intensity level k to initial scaled pixel intensity level $x_k$. Thus, scaling the pixel intensity of a pixel from a particular pixel intensity level to a corresponding scaled pixel intensity level may include setting the pixel intensity of the pixel currently having a pixel intensity level of k to the corresponding scaled pixel intensity level $x_k$. In this way, the pixels of display 18 may output colors having initial scaled pixel intensity levels $x_k$ within the compressed pixel intensity range 24.

Power saving unit 17 may estimate the power consumption of display 18 when outputting colors having initial scaled pixel intensity levels $x_k$ within the compressed pixel intensity range 24, and may determine whether there is a difference between the estimated power consumption for display 18 and a particular target power consumption for display 18. To that end, power saving unit 17 may determine an estimated power consumption for display 18 as the average per-pixel power consumption for the pixels of display 18 when outputting colors having initial scaled pixel intensity levels $x_k$ within the compressed pixel intensity range 24:

$$\text{Power}_{estimate} = \frac{\sum_{0}^{255} h_k * P(x_k)}{\sum_{0}^{255} h_k} \tag{6}$$

power saving unit 17 may estimate the power consumed by each pixel of display 18 at a pixel intensity level that is scaled according to $x_k$ as $P(x_k)$ according to the power model $P(v)$ of equation (1), and may divide the sum of the estimated power consumption by the total count of pixels of display 18 to determine an estimate of the average per-pixel power consumption $\text{Power}_{estimate}$ for the pixels of display 18. Based on the estimate of the average per-pixel power consumption $\text{Power}_{estimate}$ for the pixels of display 18 and a target per-pixel power consumption value $\text{Power}_{target}$ for display 18, power saving unit 17 may determine a power scaling ratio $\alpha$ by dividing $\text{Power}_{target}$ by $\text{Power}_{estimate}$ as follows:

$$\alpha = \frac{\text{Power}_{target}}{\text{Power}_{estimate}} \tag{7}$$

power saving unit 17 may refine the set of initial scaling pixel intensity levels based at least in part on the power scaling ratio $\alpha$ to determine scaling pixel intensity levels $x'_k$ for the pixel intensity levels k of display 18:

$$x'_k = x'_{k-1} + \left(\frac{c_k}{\sum_{1}^{255} c_k} * (\alpha * \text{Range})\right), x_0 = 0, x_k = 0, 1, \ldots, 255 \tag{8}$$

Equation (8) is similar to equation (5), except that, in equation (8), the difference between $x'_k$ and $x'_{k-1}$ is further scaled based at least in part on power scaling ratio $\alpha$. In other words, the increase in the level of intensity from $x'_{k-1}$ to $x'_k$ may be scaled by at least power scaling ratio $\alpha$.

If the estimated average per-pixel power consumption for the pixels of display 18 when outputting colors having initial scaled pixel intensity levels $x_k$ within the compressed pixel intensity range 24 is larger than the target per-pixel power consumption value, then power scaling ratio $\alpha$ may be less than 1. Thus, the contrast of scaled pixel intensity level $x'_k$ may be smaller than the contrast of corresponding initial scaled pixel intensity level $x_k$.

On the other hand, if the estimated average per-pixel power consumption for the pixels of display 18 when outputting colors having initial scaled pixel intensity levels $x_k$ within the compressed pixel intensity range 24 is smaller than the target per-pixel power consumption value, then power scaling ratio $\alpha$ may be greater than 1. In this case, the contrast of scaled pixel intensity level $x'_k$ may be greater than the contrast of corresponding initial scaled pixel intensity level $x_k$.

Similar to the set of initial scaled pixel intensity level $x_k$, each pixel intensity level k corresponds to a particular scaled pixel intensity level $x'_k$, as determined via equation (5). Power saving unit 17 may store such association of k to $x'_k$ into system memory 10, such as creating a lookup table in system memory 10, and storing into the lookup table the association of each pixel intensity level k within full pixel intensity range 26 to a particular scaled pixel intensity level $x'_k$ within compressed pixel intensity range 24. Power saving unit 17 may index into the lookup table using pixel intensity level k to determine the corresponding scaled pixel intensity level $x'_k$.

To scale down the power consumption of display 18, power saving unit 17 may scale the pixel intensity of each of the pixels of display 18 from one of the plurality of pixel intensity levels to a corresponding scaled pixel intensity level of the set of scaled pixel intensity levels. Specifically, for each pixel of display 18, power saving unit 17 may determine the pixel intensity level k at which the pixel outputs a color, and may look up, such as via a lookup table, the corresponding scaled pixel intensity level $x'_k$. Power saving unit 17 may then change the pixel intensity of the pixel from pixel intensity level k to the corresponding scaled pixel intensity level $x'_k$. Thus, scaling the pixel intensity of a pixel from a particular pixel intensity level to a corresponding scaled pixel intensity level may include setting the pixel intensity of the pixel currently having a pixel intensity level of k to the corresponding scaled pixel intensity level $x'_k$. In this way, the pixels of display 18 may output colors having scaled pixel intensity levels $x'_k$ within the compressed pixel intensity range 24.

Figure 4:
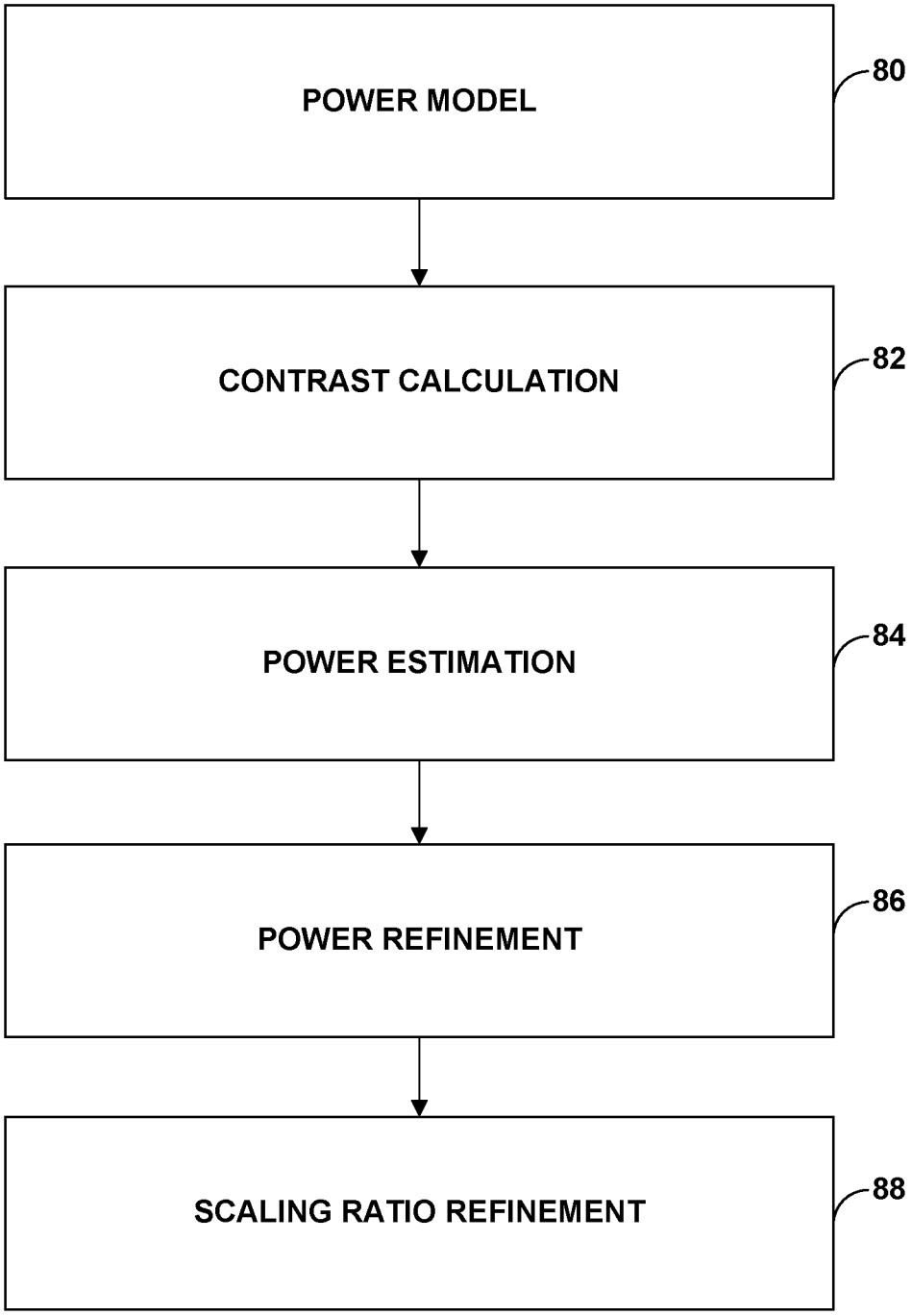
FIG. 4 is a flowchart illustrating an example process for nonlinearly scaling pixel intensity values.

FIG. 4 is a flowchart illustrating an example process for nonlinearly scaling pixel intensity values. As shown in FIG. 4, power saving unit 17 may utilize a power model, such as defined via equation (1), to determine a compressed image dynamic range (e.g., compressed pixel intensity range 24) via equation (2), to correspondingly determine a gradient index via equation (3) for the compressed pixel dynamic range (80).

Power saving unit 17 may perform contrast calculations to compensate for the lower dynamic range of the compressed image dynamic range (82). Specifically, power saving unit 17 may nonlinearly scale pixel intensity levels within the full pixel intensity range 26 to scaled pixel intensity levels within the compressed image dynamic range. Power saving unit 17 may construct a histogram of pixel intensity level distribution that indicates the distribution of pixel intensity levels within color values outputted by pixels of display 18, and perform histogram equalization for the histogram to increase the contrast of an image displayed by display 18 according to the compressed image dynamic range.

Power saving unit 17 may use equation (4) to determine a contrast enhancement index $c_k$ for each pixel intensity level in the full range of (i.e., uncompressed) pixel intensity levels (e.g., from 0 to 255) of display 18 based at least in part on the histogram (of pixel intensity levels for the pixels of display 18 operating according to the full pixel intensity range 26, and may use equation (5) to determine a set of initial scaled pixel intensity levels within the compressed pixel intensity range 24 for the plurality of pixel intensity levels within the full pixel intensity range 26 from the contrast enhancement index.

Power saving unit 17 may estimate the power consumption of display 18 when outputting colors having the set of initial scaled pixel intensity levels according to equation (6) to determine an average per-pixel power consumption for the pixels of display 18 when outputting colors of a particular image based on the set of initial scaled pixel intensity levels (84). Power saving unit 17 may perform power refinement by determining a power scaling ratio according to equation (7) to determine a power scaling ratio (86). Power saving unit 17 may refine the set of initial scaling pixel intensity levels using the power scaling ratio to determine scaling pixel intensity levels according to equation (8), and may store the set of scaling pixel intensity levels into a lookup table in system memory 10 (88).

In this way, to adjust the color values of an image displayed by display 18, power saving unit 17 may, for each pixel, index into the lookup table using the intensity value of the pixel (as stored in a frame buffer) to determine a scaled intensity value for the pixel. Power saving unit 17 may direct display 18 to output a pixel having hue and saturation values as stored in the frame buffer and having an intensity value that is the scaled intensity value as determined from the lookup table.

The techniques disclosed throughout this disclosure may enable a computing device, such as computing device 2, to perform major power savings without the complex calculations and powerful processors required of other power saving techniques. As such, the techniques disclosed throughout this disclosure may enable a relatively less powerful set of processing units to perform low-latency power savings by quickly determining a compressed image dynamic range, while enhancing the quality of the image output by display 18 by performing contrast enhancement.

In one power saving example, In one example, the amount of power saved by performing the techniques disclosed herein may be quantified according to the ratio of power consumed to display an image while utilizing the power saving techniques disclosed herein over the power consumed to display the same image without utilizing the techniques disclosed herein, as follows:

$$\text{power ratio} = \frac{\text{display power (solution on)} - \text{panel power (black, solution off)}}{\text{display power (solution on)} - \text{panel power (black, solution off)}},$$

where display power (solution on) is the power consumed by display 18 to display a particular image using the power savings techniques disclosed herein, display power (solution off) is the power consumed by display 18 to display the particular image without using the power saving techniques disclosed herein, and panel power (black, solution off) is the power consumed by display 18 to display a totally black image.

Given a target scaling ratio of 80%, a power consumption of display 18 operating at full pixel intensity range 26 of 419 mW (out of 1023 mW), and a gradient index of 0.9035, the power ratio may be:

$$\text{power ratio} = \frac{197.75\,\text{mA} - 113.28\,\text{mA}}{222.42\,\text{mA} - 113.28\,\text{mA}} = 0.7740 = 77.4\%.$$

In this example, computing device 2 may reduce power consumption of display 18 by close to 23% by utilizing the techniques disclosed herein.

Figure 5:
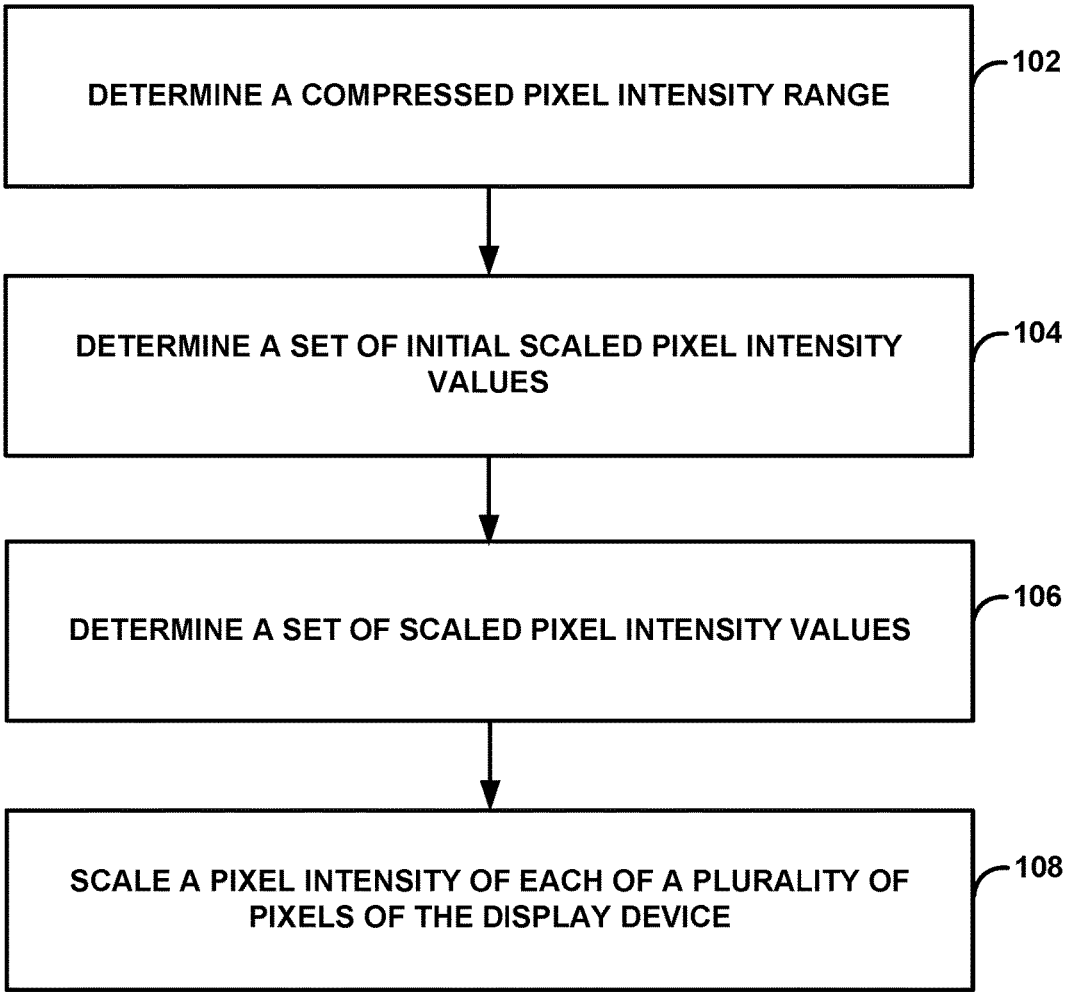
FIG. 5 is a flowchart illustrating an example process for nonlinearly scaling pixel intensity values.

FIG. 5 is a flowchart illustrating an example process for nonlinearly scaling pixel intensity values. As shown in FIG. 5, power saving unit 17 may determine a compressed pixel intensity range 24 for a plurality of pixel intensity levels of a display 18 based at least in part on a target power scaling value (102). The plurality of pixel intensity levels of display 18 may be a plurality of pixel intensity levels within full pixel intensity range 26. Power saving unit 17 may determine a power consumption value associated with a maximum intensity level of a full pixel intensity range 26 for display 18, scale the associated power consumption value by the target power scaling value, and determine a pixel intensity level associated with the scaled power consumption value. Power saving unit 17 may determine the pixel intensity level associated with the scaled power consumption value as the maximum pixel intensity level of the compressed pixel intensity range 24, and may determine that the compressed pixel intensity range 24 ranges from a minimum pixel intensity level of 0 to the maximum pixel intensity level.

Power saving unit 17 may determine a set of initial scaled pixel intensity levels for the plurality of pixel intensity levels based at least in part on the compressed pixel intensity range 24 (104). Specifically, for each pixel intensity k within the plurality of pixel intensity levels of display 18, power saving unit 17 may determine a corresponding initial scaled pixel intensity level $x_k$ within the compressed pixel intensity range 24.

Power saving unit 17 may determine a set of scaled pixel intensity levels based at least in part on an estimated power consumption value associated with the set of initial scaled pixel intensity levels (106). Power saving unit 17 may determine an estimated power consumption value associated with the set of scaled pixel intensity levels, and may adjust the set of scaled pixel intensity levels based on the difference between the estimated power consumption value associated with the set of initial scaled pixel intensity levels and a target power consumption value to result in the set of scaled pixel intensity levels.

Power saving unit 17 may scale a pixel intensity of each of a plurality of pixels of the display device from one of the plurality of pixel intensity levels to a corresponding scaled pixel intensity level of the set of scaled pixel intensity levels $x'_k$ (108). Power saving unit 17 may, for each pixel of display 18, determine the pixel intensity level k of the pixel, and may set the pixel intensity of the pixel to a corresponding scaled pixel intensity level $x'_k$.

In some examples, determining the set of initial scaled pixel intensity levels may further include determining a contrast enhancement index for each of the plurality of intensity levels based at least in part on a frequency of each of the plurality of pixel intensity levels within output colors of the plurality of pixels of the display 18, and determining the set of initial scaled pixel intensity levels based at least in part on the contrast enhancement index for each of the plurality of pixel intensity levels. Specifically, power saving unit 17 may generate a histogram of the plurality of pixel intensity levels at which the pixels of display 18 are outputting, where each bin in the histogram may be one of the plurality of pixel intensity levels, and where the count of each of the bins in the histogram may be the frequency of that particular pixel intensity level associated with display 18. Power saving unit 17 may generate a contrast enhancement index for a particular pixel intensity level based at least in part on the frequency of that particular pixel intensity level associated with display 18.

In some examples, determining the set of initial scaled pixel intensity levels based at least in part on the contrast enhancement index for each of the plurality of pixel intensity levels may further include determining a contrast for each initial scaled pixel intensity level of the set of initial scaled pixel intensity levels based at least in part on the contrast enhancement index for a corresponding pixel intensity level of the plurality of intensity levels.

The contrast for an initial scaled pixel intensity level may correlate with the difference in pixel intensity between the initial scaled pixel intensity level for a particular pixel intensity level within the plurality of pixel intensity levels and the initial scaled pixel intensity level for the next lowest pixel intensity level within the plurality of pixel intensity levels. Such a difference may correlate with the contrast enhancement index for the particular pixel intensity level.

In some examples, determining the set of scaled pixel intensity levels may further include determining a power scaling ratio as a ratio of the estimated power consumption value to a target power consumption value and determining the set of scaled pixel intensity levels based at least in part on the power scaling ratio.

In some examples, determining the set of scaled pixel intensity levels may further include determining the contrast for each scaled pixel intensity level of the set of scaled pixel intensity levels based at least in part on the power scaling ratio and the contrast enhancement index for the corresponding intensity level of the plurality of pixel intensity levels.

In some examples, determining the compressed pixel intensity range for the plurality of pixel intensity levels of the display device may further include determining a power consumption value associated with a maximum pixel intensity level out of the plurality of pixel intensity levels, scaling the power consumption value according to the target power scaling value, and determining a maximum pixel intensity level for the compressed pixel intensity range based at least in part on the scaled power consumption value.

In some examples, each of the plurality of pixel intensity levels for the display device comprises a value component of a hue-saturation-value (HSV) color space. In some examples, the display device comprises an organic light-emitting-diode (OLED) display device.

In one or more examples, the functions described may be implemented in hardware, software, firmware, or any combination thereof. If implemented in software, the functions may be stored on, as one or more instructions or code, a computer-readable medium and executed by a hardware-based processing unit. Computer-readable media may include computer-readable storage media, which corresponds to a tangible medium such as data storage media. In this manner, computer-readable media generally may correspond to tangible computer-readable storage media which is non-transitory. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood that computer-readable storage media and data storage media do not include carrier waves, signals, or other transient media, but are instead directed to non-transient, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

This disclosure also includes attached appendices, which forms part of this disclosure and is expressly incorporated herein. The techniques disclosed in the appendices may be performed in combination with or separately from the techniques disclosed herein.

Various examples have been described. These and other examples are within the scope of the following claims.

What is claimed is:

1. A method comprising:

determining, by at least one processor, a compressed pixel intensity range for a plurality of pixel intensity levels of a display device based at least in part on a target power scaling value, wherein the target power scaling value is associated with a target power consumption of the display device to display an image;

determining, by the at least one processor, a set of initial scaled pixel intensity levels for the plurality of pixel intensity levels based at least in part on the compressed pixel intensity range;

determining, by the at least one processor, an estimated power consumption value, wherein the estimated power consumption value is associated with an estimated power consumption of the display device to display the image according to the set of initial scaled pixel intensity levels;

determining, by the at least one processor, a set of scaled pixel intensity levels based at least in part on a ratio of the target power scaling value to the estimated power consumption value; and scaling a pixel intensity of each of a plurality of pixels of the display device from one of the plurality of pixel intensity levels to a corresponding scaled pixel intensity level of the set of scaled pixel intensity levels to display, by the display device, the image according to the set of scaled pixel intensity levels.

2. The method of claim 1, wherein determining the set of initial scaled pixel intensity levels further comprises:

determining a contrast enhancement index for each of the plurality of pixel intensity levels to display, by the display device, the image according to the scaled pixel intensity level based at least in part on a frequency of the respective pixel intensity level within output colors of the plurality of pixels of the display device; and determining the set of initial scaled pixel intensity levels based at least in part on the contrast enhancement index for each of the plurality of pixel intensity levels.

3. The method of claim 2, wherein determining the set of initial scaled pixel intensity levels further comprises:

determining a contrast for each initial scaled pixel intensity level of the set of initial scaled pixel intensity levels based at least in part on the contrast enhancement index for a corresponding intensity level of the plurality of intensity levels.

4. The method of claim 3, wherein determining the set of scaled pixel intensity levels further comprises:

determining the contrast for each scaled pixel intensity level of the set of scaled pixel intensity levels based at least in part on the target power scaling value, the estimated power consumption value, and the contrast enhancement index for the corresponding pixel intensity level of the plurality of pixel intensity levels.

5. The method of claim 1, wherein determining the compressed pixel intensity range for the plurality of pixel intensity levels of the display device further comprises:

determining a power consumption value associated with a maximum pixel intensity level out of the plurality of pixel intensity levels;

scaling the power consumption value according to the target power scaling value; and determining a maximum pixel intensity level for the compressed pixel intensity range based at least in part on the scaled power consumption value.

6. The method of claim 1, wherein each of the plurality of pixel intensity levels for the display device comprises a value component of a hue-saturation-value (HSV) color space.

7. The method of claim 1, wherein the display device comprises an organic light-emitting-diode (OLED) display device.

8. A computing device comprising:

a display; and at least one processor configured to:

determine a compressed pixel intensity range for a plurality of pixel intensity levels of the display based at least in part on a target power scaling value, wherein the target power scaling value is associated with a target power consumption of the display to display an image;

determine a set of initial scaled pixel intensity levels for the plurality of pixel intensity levels based at least in part on the compressed pixel intensity range;

determine an estimated power consumption value, wherein the estimated power consumption value is associated with an estimated power consumption of the display to display the image according to the set of initial scaled pixel intensity levels;

determine a set of scaled pixel intensity levels based at least in part on a ratio of the target power scaling value to the estimated power consumption value; and scale a pixel intensity of each of a plurality of pixels of the display from one of the plurality of pixel intensity levels to a corresponding scaled pixel intensity level of the set of scaled pixel intensity levels to display, by the display, the image according to the set of scaled pixel intensity levels.

9. The computing device of claim 8, wherein the at least one processor is further configured to:

determine a contrast enhancement index for each of the plurality of pixel intensity levels to display, by the display, the image according to the scaled pixel intensity level based at least in part on a frequency of the respective pixel intensity level within output colors of the plurality of pixels of the display; and determine the set of initial scaled pixel intensity levels based at least in part on the contrast enhancement index for each of the plurality of pixel intensity levels.

10. The computing device of claim 9, wherein the at least one processor is further configured to:

determine a contrast for each initial scaled pixel intensity level of the set of initial scaled pixel intensity levels based at least in part on the contrast enhancement index for a corresponding intensity level of the plurality of intensity levels.

11. The computing device of claim 10, wherein the at least one processor is further configured to:

determine the contrast for each scaled pixel intensity level of the set of scaled pixel intensity levels based at least in part on the target power scaling value, the estimated power consumption value, and the contrast enhancement index for the corresponding pixel intensity level of the plurality of pixel intensity levels.

12. The computing device of claim 8, wherein at least one processor is further configured to:

determine a power consumption value associated with a maximum pixel intensity level out of the plurality of pixel intensity levels;

scale the power consumption value according to the target power scaling value; and determine a maximum pixel intensity level for the compressed pixel intensity range based at least in part on the scaled power consumption value.

13. The computing device of claim 8, wherein each of the plurality of pixel intensity levels for the display comprises a value component of a hue-saturation-value (HSV) color space.

14. The computing device of claim 8, wherein the display comprises an organic light-emitting-diode (OLED) display device.

15. A non-transitory computer-readable storage medium storing instructions that, when executed, cause at least one processor to:

determine a compressed pixel intensity range for a plurality of pixel intensity levels of a display device based at least in part on a target power scaling value, wherein the target power scaling value is associated with a target power consumption of the display device to display an image;

determine a set of initial scaled pixel intensity levels for the plurality of pixel intensity levels based at least in part on the compressed pixel intensity range;

determine an estimated power consumption value, wherein the estimated power consumption value is associated with an estimated power consumption of the display device to display the image according to the set of initial scaled pixel intensity levels;

determine a set of scaled pixel intensity levels based at least in part on a ratio of the target power scaling value to the estimated power consumption value; and scale a pixel intensity of each of a plurality of pixels of the display device from one of the plurality of pixel intensity levels to a corresponding scaled pixel intensity level of the set of scaled pixel intensity levels to display, by the display device, the image according to the set of scaled pixel intensity levels.

16. The non-transitory computer-readable storage medium of claim 15, wherein the instructions further cause the at least one processor to:

determine a contrast enhancement index for each of the plurality of pixel intensity levels to display, by the display device, the image according to the scaled pixel intensity level based at least in part on a frequency of the respective pixel intensity level within output colors of the plurality of pixels of the display device; and determine the set of initial scaled pixel intensity levels based at least in part on the contrast enhancement index for each of the plurality of pixel intensity levels.

17. The non-transitory computer-readable storage medium of claim 16, wherein the instructions further cause the at least one processor to:

determine a contrast for each initial scaled pixel intensity level of the set of initial scaled pixel intensity levels based at least in part on the contrast enhancement index for a corresponding intensity level of the plurality of intensity levels.

18. The non-transitory computer-readable storage medium of claim 17, wherein the instructions further cause the at least one processor to:

determine the contrast for each scaled pixel intensity level of the set of scaled pixel intensity levels based at least in part on the target power scaling value, the estimated power consumption value and the contrast enhancement index for the corresponding pixel intensity level of the plurality of pixel intensity levels.

19. The non-transitory computer-readable storage medium of claim 15, wherein the instructions further cause the at least one processor to:

determine a power consumption value associated with a maximum pixel intensity level out of the plurality of pixel intensity levels;

scale the power consumption value according to the target power scaling value; and determine a maximum pixel intensity level for the compressed pixel intensity range based at least in part on the scaled power consumption value.

20. The non-transitory computer-readable storage medium of claim 15, wherein each of the plurality of pixel intensity levels for the display device comprises a value component of a hue-saturation-value (HSV) color space.

21. An apparatus comprising:

means for determining a compressed pixel intensity range for a plurality of pixel intensity levels of a display device based at least in part on a target power scaling value, wherein the target power scaling value is associated with a target power consumption of the display device to display an image;

means for determining a set of initial scaled pixel intensity levels for the plurality of pixel intensity levels based at least in part on the compressed pixel intensity range;

means for determining an estimated power consumption value, wherein the estimated power consumption value is associated with an estimated power consumption of the display device to display the image according to the set of initial scaled pixel intensity levels;

means for determining a set of scaled pixel intensity levels based at least in part on a ratio of the target power scaling value to the estimated power consumption value; and means for scaling a pixel intensity of each of a plurality of pixels of the display device from one of the plurality of pixel intensity levels to a corresponding scaled pixel intensity level of the set of scaled pixel intensity levels to display, by the display device, the image according to the set of scaled pixel intensity levels.

22. The apparatus of claim 21, wherein the means for determining the set of initial scaled pixel intensity levels further comprises:

means for determining a contrast enhancement index for each of the plurality of pixel intensity levels to display, by the display device, the image according to the scaled pixel intensity level based at least in part on a frequency of the respective pixel intensity level within output colors of the plurality of pixels of the display device; and means for determining the set of initial scaled pixel intensity levels based at least in part on the contrast enhancement index for each of the plurality of pixel intensity levels.

23. The apparatus of claim 22, wherein the means for determining the set of initial scaled pixel intensity levels further comprises:

means for determining a contrast for each initial scaled pixel intensity level of the set of initial scaled pixel intensity levels based at least in part on the contrast enhancement index for a corresponding intensity level of the plurality of intensity levels.

24. The apparatus of claim 23, wherein the means for determining the set of scaled pixel intensity levels further comprises:

means for determining the contrast for each scaled pixel intensity level of the set of scaled pixel intensity levels based at least in part on the target power scaling value, the estimated power consumption value, and the contrast enhancement index for the corresponding pixel intensity level of the plurality of pixel intensity levels.

25. The apparatus of claim 21, wherein the means for determining the compressed pixel intensity range for the plurality of pixel intensity levels of the display device further comprises:

means for determining a power consumption value associated with a maximum pixel intensity level out of the plurality of pixel intensity levels;

means for scaling the power consumption value according to the target power scaling value; and means for determining a maximum pixel intensity level for the compressed pixel intensity range based at least in part on the scaled power consumption value.

26. The apparatus of claim 21, wherein each of the plurality of pixel intensity levels for the display device comprises a value component of a hue-saturation-value (HSV) color space.

* * * * *